US011399998B2

(12) United States Patent
Shih et al.

(10) Patent No.: US 11,399,998 B2
(45) Date of Patent: Aug. 2, 2022

(54) FOLDABLE ELECTRIC BED

(71) Applicant: Chuan-Hang Shih, Changhua County (TW)

(72) Inventors: Chuan-Hang Shih, Changhua County (TW); Yu-Chi Yang, Changhua County (TW)

(73) Assignee: Chuan-Hang Shih, Changhua County (TW)

( * ) Notice: Subject to any disclaimer, the term of this patent is extended or adjusted under 35 U.S.C. 154(b) by 99 days.

(21) Appl. No.: 16/881,417

(22) Filed: May 22, 2020

(65) Prior Publication Data

US 2021/0346219 A1 Nov. 11, 2021

(30) Foreign Application Priority Data

May 11, 2020 (TW) ..... 109115559

(51) Int. Cl.
*A61G 7/018* (2006.01)
*A61G 7/015* (2006.01)
*A47C 20/04* (2006.01)

(52) U.S. Cl.
CPC ..... *A61G 7/018* (2013.01); *A47C 20/041* (2013.01); *A61G 7/015* (2013.01)

(58) Field of Classification Search
CPC ..... A47C 20/041; A47C 19/122; A47C 17/74
See application file for complete search history.

(56) References Cited

U.S. PATENT DOCUMENTS

2018/0116413 A1* 5/2018 Lo ..... A47C 19/025
2020/0221881 A1* 7/2020 Huang ..... A47C 19/025

* cited by examiner

*Primary Examiner* — Peter M. Cuomo
*Assistant Examiner* — Adam C Ortiz
(74) *Attorney, Agent, or Firm* — Muncy, Geissler, Olds & Lowe, P.C.

(57) ABSTRACT

A foldable electric bed includes a first bed frame having top and bottom edges at first top and bottom planes respectively, and a second bed frame having top and bottom edges at second top and bottom planes respectively. A first fixation frame of the first bed frame has a bottom portion with two first longitudinal rods pivotally connected at outer lateral sides of two second longitudinal rods provided at a bottom portion of a second fixation frame of the second bed frame in a way that the first bottom plane is located between the second top and bottom planes and an overall height of the electric bed is less than a sum of the heights of the first and second bed frames when the electric bed is folded. As such, the folded electric bed has a reduced volume, facilitating transportation and storage.

9 Claims, 12 Drawing Sheets

FOLDABLE ELECTRIC BED

BACKGROUND OF THE INVENTION

1. Field of the Invention

The present invention relates generally to an electric bed and more particularly, to a foldable electric bed.

2. Description of the Related Art

Electric beds are extensively used in hospitals and also sold in a large amount in the home industry market due to the advantageous function that the angle of the bed body supporting the various body portions of the user can be freely adjusted. Since electric beds have components such as motors, they have considerable volume and weight, resulting in inconvenience in transportation and storage thereof. To solve the disadvantage of the conventional electric beds, dismantlable electric beds have been developed and commercially available. However, dismantlable electric beds have problems of complexity in dismantling procedure and inconvenience in use. Foldable electric beds are configured to be directly folded to reduce volume without the need of complicated dismantling procedure, thereby achieving the effect of convenient transportation and storage. However, commercially available foldable electric beds still have considerable volume because the overall thickness of the foldable electric bed under the folded state will be greater than a sum of the thicknesses of respective parts of the bed. As such, the commercially available foldable electric beds are still needed to be improved in consideration of the convenience of transportation thereof.

SUMMARY OF THE INVENTION

The present invention has been accomplished in view of the above-noted circumstances. It is an objective of the present invention to provide a foldable electric bed, which has an overall thickness smaller than a sum of the heights of first and second bed frames when it is folded so as to enhance convenience of use of the electric beds and to solve the problems of bulky volume and inconvenience of transportation of conventional electric beds.

To attain the above objectives, the present invention provides a foldable electric bed comprising a first bed frame, a second bed frame, and at least one pivot shaft. The first bed frame comprises a first fixation frame, a first moveable frame disposed with the first fixation frame, and a first actuator having two ends disposed with the first fixation and moveable frames, respectively. The first bed frame has a top edge located at a first top plane, a bottom edge located at a first bottom plane, and a first height equal to a distance between the first top plane and the first bottom plane. The first fixation frame has at least one first pivot hole. The second bed frame comprises a second fixation frame, a second moveable frame disposed with the second fixation frame, and a second actuator having two ends disposed with the second fixation and moveable frames, respectively. The second bed frame has a top edge located at a second top plane, a bottom edge located at a second bottom plane, and a second height equal to a distance between the second top plane and the second bottom plane and equal to the first height. The second fixation frame has at least one second pivot hole. The at least one pivot shaft is inserted through the at least one first pivot hole and the at least one second pivot hole in a way that the first bed frame is rotatable relative to the second bed frame about the at least one pivot shaft, such that the electric bed is foldable.

The electric bed is configured in a way that when the first bed frame and the second bed frame are extended with respect to each other, the first top plane is coplanar with the second top plane, the first bottom plane is coplanar with the second bottom plane, and the electric bed has an overall height equal to the first height, and when the first bed frame and the second bed frame are folded with respect to each other, an overall height of the electric bed under fold is equal to a distance between the first top plane and the second top plane and less than a sum of the first height and the second height. As a result, the folded electric bed has a reduced volume, thereby achieving the effect of convenient transportation and storage thereof.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
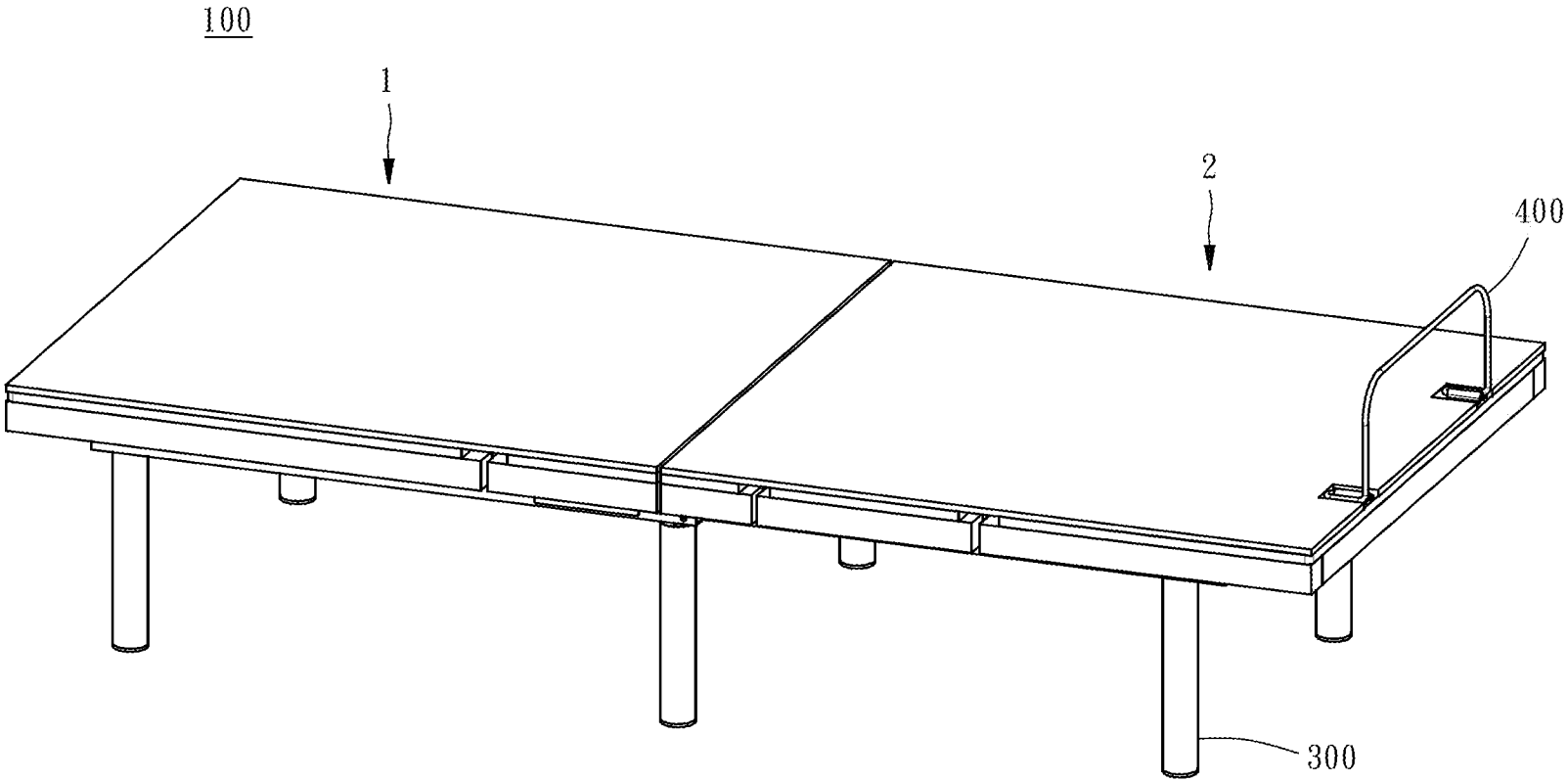
FIG. 1 is a perspective view of a foldable electric bed according to a first embodiment of the present invention.
Figure 2:
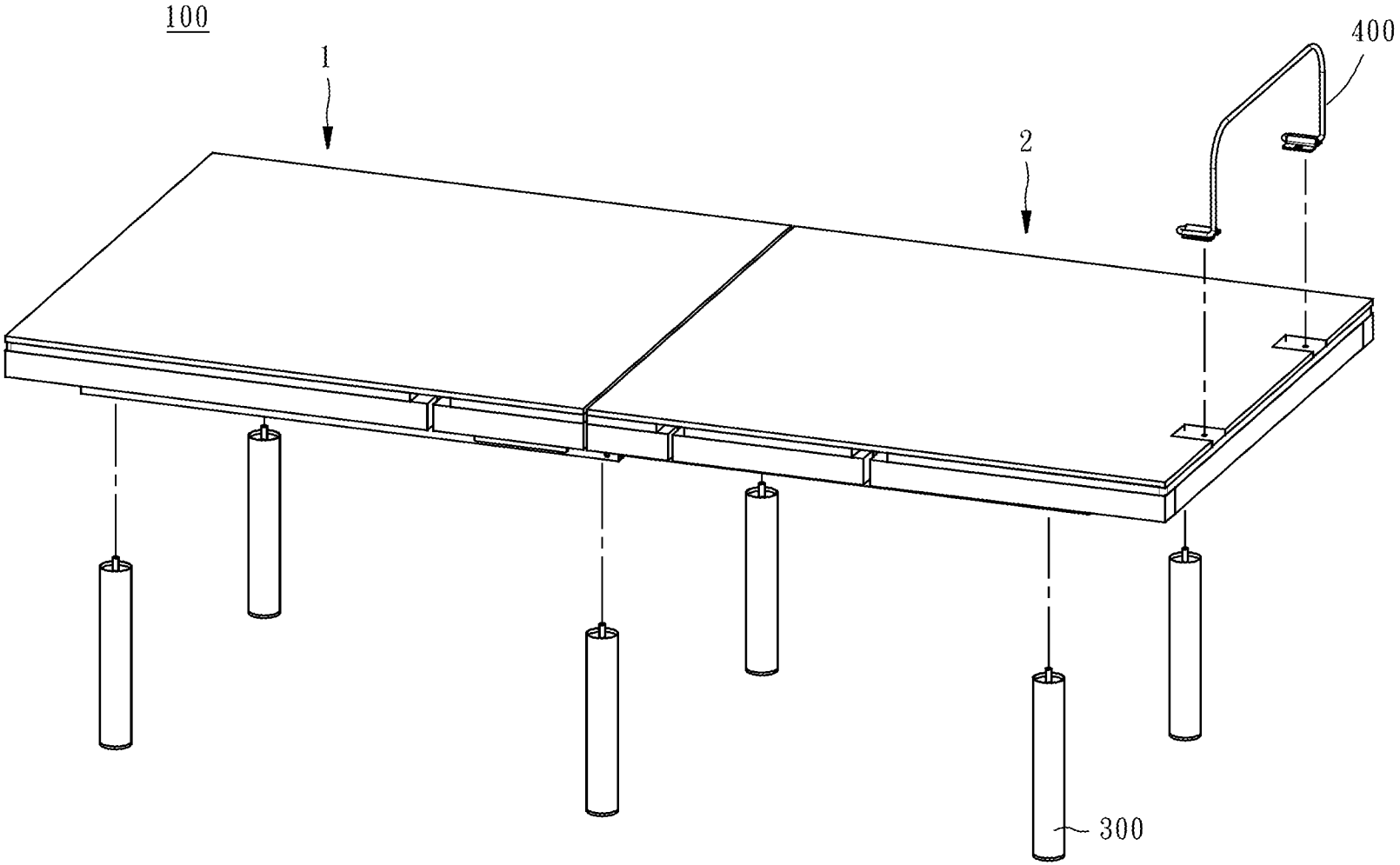
FIG. 2 is an exploded view of the foldable electric bed of the first embodiment of the present invention.

The structure and technical features of the present invention will be detailedly described hereunder by two embodiments and accompany drawings. As shown in FIGS. 1-2, a foldable electric bed 100 provided in accordance with a first embodiment of the present invention is composed of a first bed frame 1 and a second bed frame 2. The first and second bed frames 1 and 2 combinedly form a bed bod for supporting a mattress (not shown) thereon or being used after encapsulated with sponge material. Support legs 300 may be optionally mounted to the bottom of the bed body. Alternatively, the bed body can be directly placed on a plane, such as a bed surface, ground or floor, when it is in use. A mattress stopper 400 may be optionally mounted to the tail end of the second bed frame 2.

Figure 3:
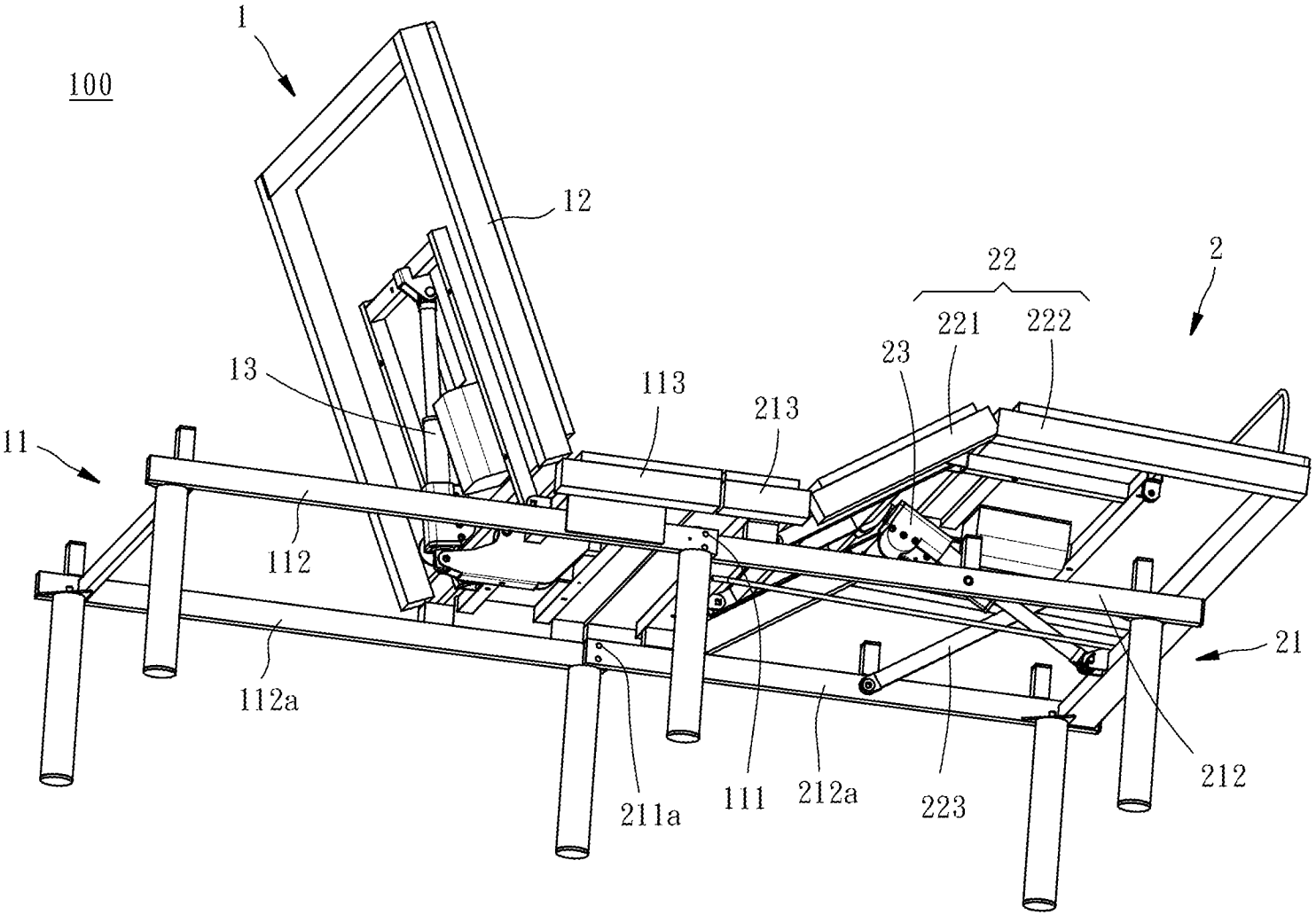
FIG. 3 is a perspective view of the foldable electric bed of the first embodiment of the present invention, showing a first moveable frame and a second moveable frame are in inclined positions.

Referring to FIG. 3, the first bed frame 1 includes a first fixation frame 11, a first moveable frame 12 disposed to the first fixation frame 11, and a first actuator 13 having two ends disposed to the first fixation frame 11 and the first moveable frame 12, respectively. Specifically, the first fixation frame 11 includes a first buttock supporting plate 113 having a front end pivotally connected with a rear end of the first moveable frame 12. The first actuator 13 may be, but not limited to, an electric cylinder composed of a cylinder body and a slidable rod that can outwardly protrude from and inwardly retract into the cylinder body. The cylinder body has an end pivotally connected with the first buttock supporting plate 113, and the slidable rod has an end pivotally connected with the first movable frame 12. When the slidable rod of the first actuator 13 outwardly extends from the cylinder body to increase the total length of the first actuator 13, the first actuator 13 drives the first moveable frame 12 to upwardly swing relative to the first buttock supporting plate 113 to lift up the user's upper body.

As shown in FIG. 3, the second bed frame 2 includes a second fixation frame 21, a second moveable frame 22 disposed to the second fixation frame 21, and a second actuator 23 having two ends disposed to the second fixation frame 21 and the second moveable frame 22, respectively. Specifically, the second fixation frame 21 includes a second buttock supporting plate 213, and the second movable frame 22 includes a first leg supporting plate 221 and a second leg supporting plate 222. The second buttock supporting plate 213 and the first buttock supporting plate 113 combinedly support user's buttocks. The first leg supporting plate 221 has a front end pivotally connected with a rear end of the second buttock supporting plate 213, and the second leg supporting plate 222 has a front end pivotally connected with a rear end of the first leg supporting plate 221 The second actuator 23 may be, but not limited to, an electric cylinder composed of a cylinder body and a slidable rod that can outwardly protrude from and inwardly retract into the cylinder body. The cylinder body has an end pivotally connected with the first leg supporting plate 221 of the second movable frame 22, and the slidable rod has an end pivotally connected with the second fixation frame 21. When the slidable rod of the second actuator 23 outwardly extends from the cylinder body, the second actuator 23 drives the first leg supporting plate 221 to upwardly swing relative to the second buttock supporting plate 213 to lift up the user's legs. The second bed frame 2 further includes a link 223 pivotally connected between the second fixation frame 21 and the second leg supporting plate 222. As such, when the first leg supporting plate 221 upwardly swings, the second leg supporting plate 222 will be synchronously lifted up.

The first fixation frame 11 of the first bed frame 1 of the foldable electric bed 100 of the present invention includes at least one first pivot hole, and the second fixation frame 21 of the second bed frame 2 includes at least one second pivot hole. The electric bed 100 further comprises at least one pivot shaft inserted through the first pivot hole and the second pivot hole in a way that the first bed frame 1 is rotatable relative to the second bed frame 2 about the pivot shaft, such that the electric bed 1 is foldable. In the first embodiment of the present invention, the first fixation frame 11 has, but not limited to, two first pivot holes 111 and 111*a* (the reference numeral 111*a* denoting a first pivot hole is not shown in FIG. 3), and the second fixation frame 21 has, but not limited to, two second pivot holes 211 and 211*a* (the reference numeral 211 denoting a second pivot hole is not shown in FIG. 3). In another embodiment, the first fixation frame 11 has two first pivot holes, and the second fixation frame 21 has only one second pivot hole located between the two first pivot holes.

Figure 4:
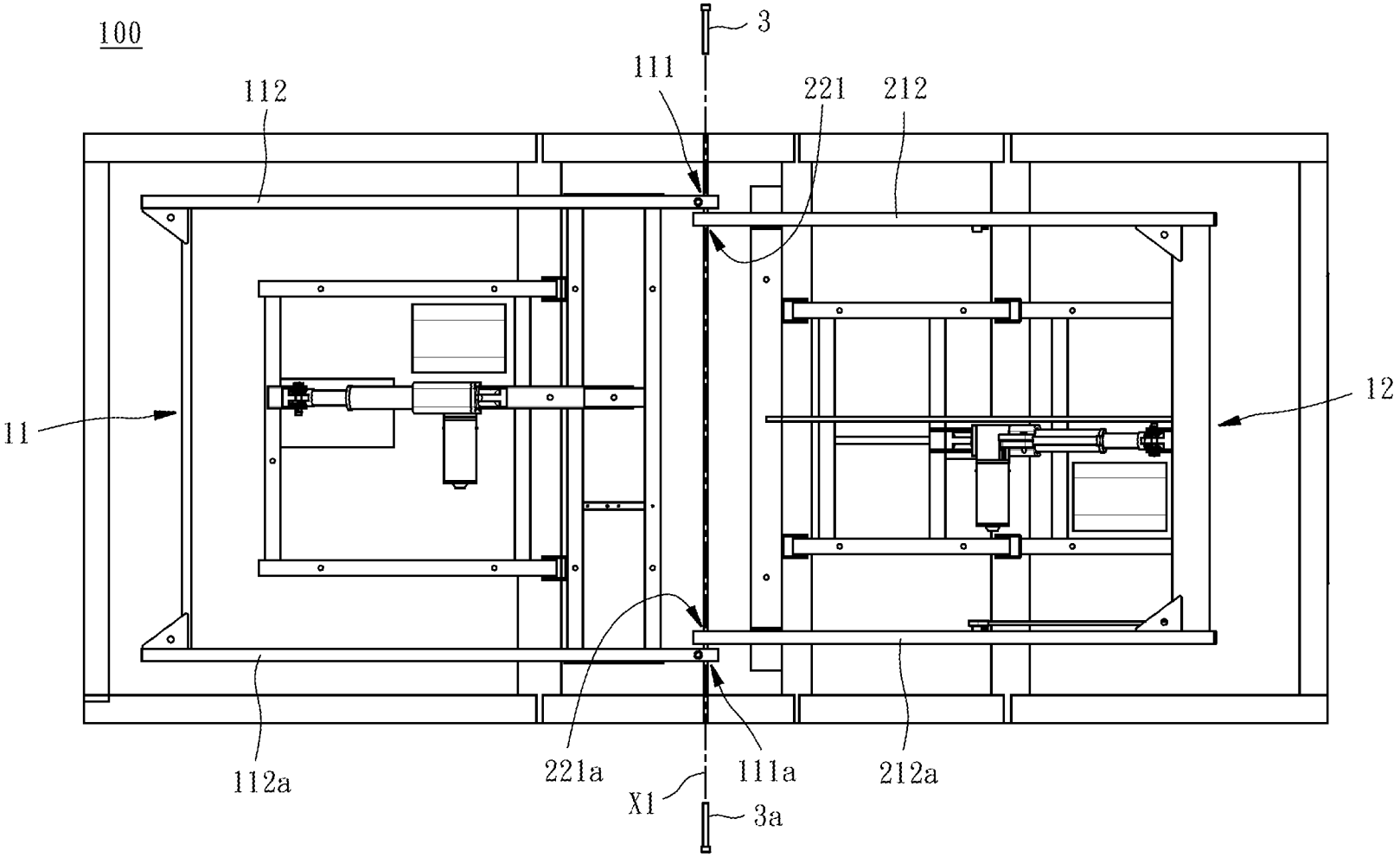
FIG. 4 is a bottom view of the foldable electric bed of the first embodiment of the present invention.

Referring to FIGS. 3 and 4, in the first embodiment, the first fixation frame 11 has a bottom structure having approximately an inverted U shape with two first longitudinal rods 112 and 112*a*, and the second fixation frame 21 has a bottom structure having approximately an inverted U shape with two second longitudinal rods 212 and 212*a*. The bottom structure of the second fixation frame 21 has a size lightly smaller than the size of the bottom structure of the first fixation frame 11. That is, a distance between the two second longitudinal rods 212 and 212*a* is smaller than the distance between the two first longitudinal rods 112 and 112*a*. The two first pivot holes 111 and 111*a* are located at the two first longitudinal rods 112 and 112*a*, respectively, and aimed at with each other in a line. The two second pivot holes 211 and 211*a* are located at the two second longitudinal rods 212 and 212*a*, respectively, and aimed at with each other in a line. The two second longitudinal rods 212 and 212*a* are located between the two first longitudinal rods 112 and 112*a*, such that the two second pivot holes 211 and 211*a* are located between the two first pivot holes 111 and 111*a* in a way that the two second pivot holes 211 and 211*a* are in alignment with the two first pivot holes 111 and 111*a* in a line.

The electric bed 100 further comprises two pivot shafts 3 and 3*a* arranged along a first imaginary axis X1 in a way that the pivot shaft 3 is inserted through the first pivot hole 111 and the second pivot hole 211, and the pivot shaft 3*a* is inserted through the first pivot hole 111*a* and the second pivot hole 211*a*. By means of the arrangement of the pivot shafts 3 and 3*a*, the first fixation frame 11 is pivotally connected with the second fixation frame 21, such that the first bed frame 1 can be rotated relative to the second bed frame 2 about the two pivot shafts 3 and 3*a*, i.e. the first imaginary axis X1 serves as the pivotal axis. As a result, the electric bed 100 can be folded.

However, it to be understood that the structures of the first and second fixation frames 11 and 21 may have various modifications, and are not limited to the disclosure of the above-mentioned first embodiment.

Figure 5:
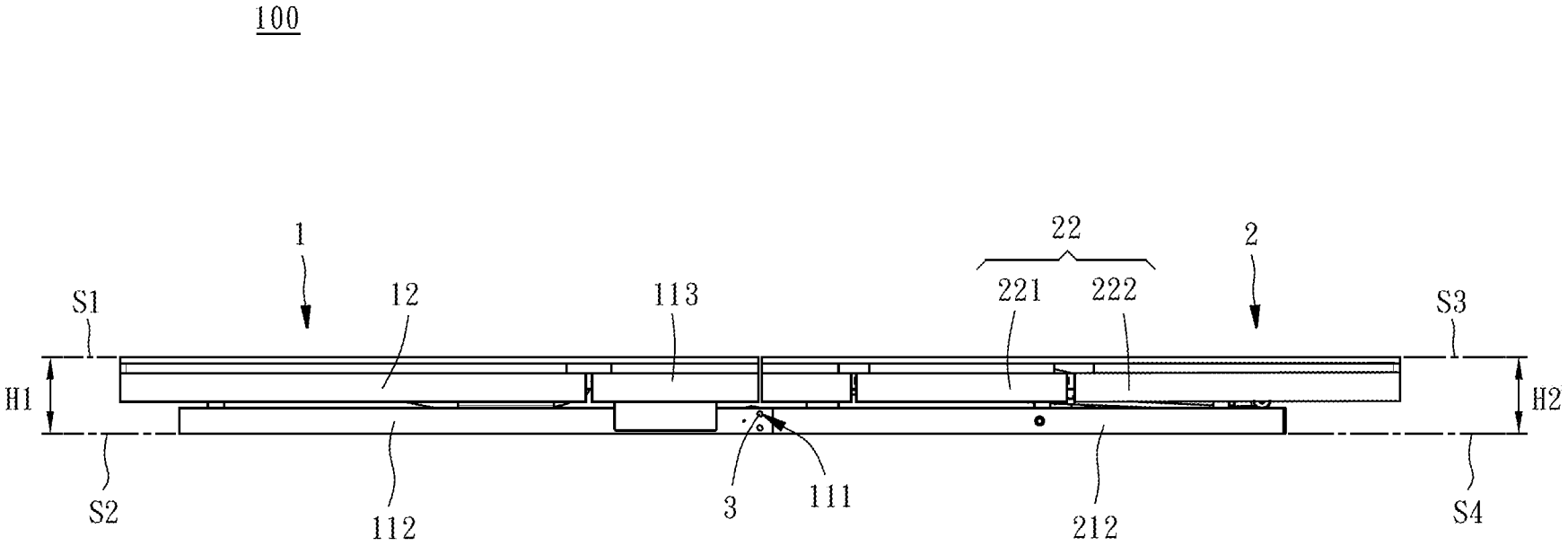
FIG. 5 is a lateral side view of the foldable electric bed of the first embodiment of the present invention.

Referring to FIG. 5, the first bed frame 1 has a top edge located at a first top plane S1, a bottom edge located at a first bottom plane S2 that is parallel to the first top plane S1, and a first height H1 equal to a distance between the first top plane S1 and the first bottom plane S2. Similarly, the second bed frame 2 has a top edge located at a second top plane S3, a bottom edge located at a second bottom plane S4 that is parallel to the second top plane S3, and a second height H2 equal to a distance between the second top plane S3 and the second bottom plane S4. When the foldable electric bed 100 fully extends, i.e. the first bed frame 1 and the second bed frame 2 are extended with respect to each other, the first top plane S1 is coplanar with the second top plane S3, the first bottom plane S2 is coplanar with the second bottom plane S4. At this state, the electric bed 100 can be placed on a plane, such a bed surface, floor or ground, for being used, and the electric bed 100 will have an overall height equal to the first height H1 or the second height H2.

Figure 6:
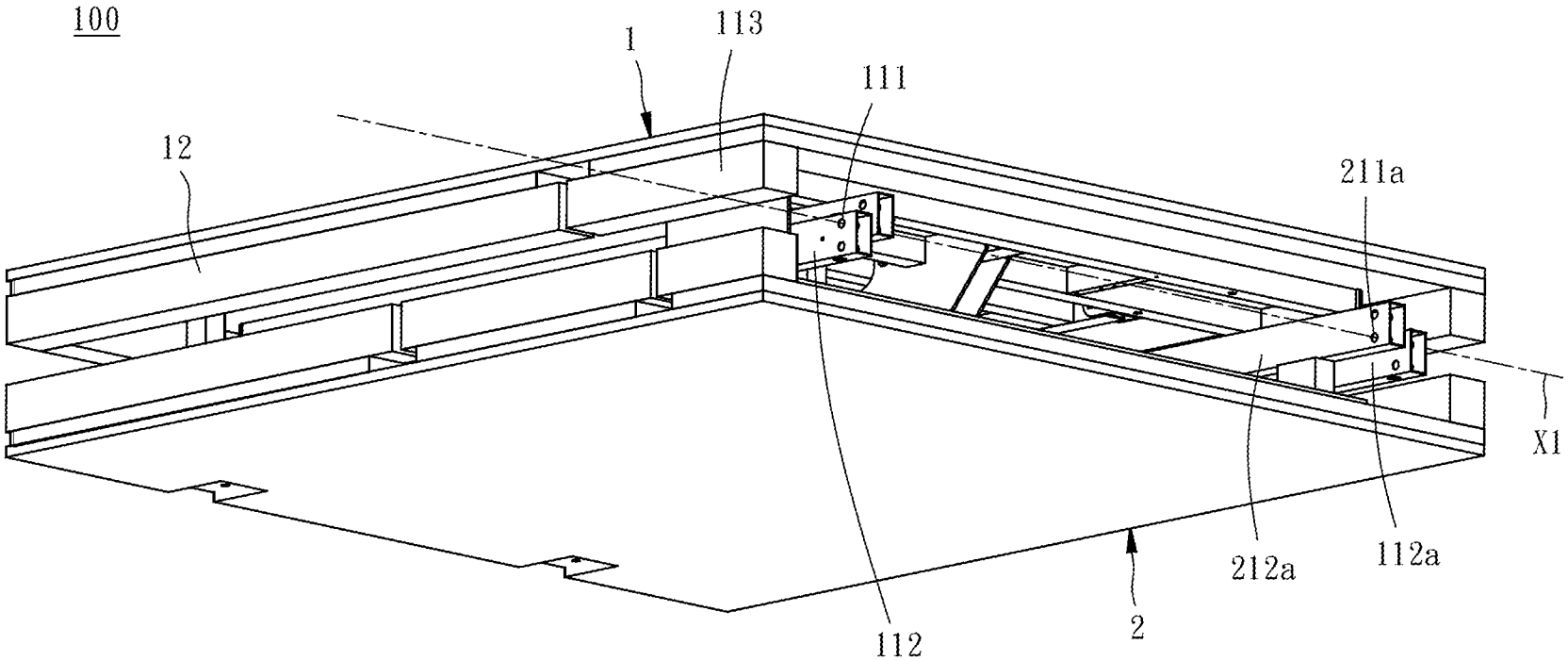
FIG. 6 is a perspective view showing the foldable electric bed of the first embodiment of the present invention is folded.
Figure 7:
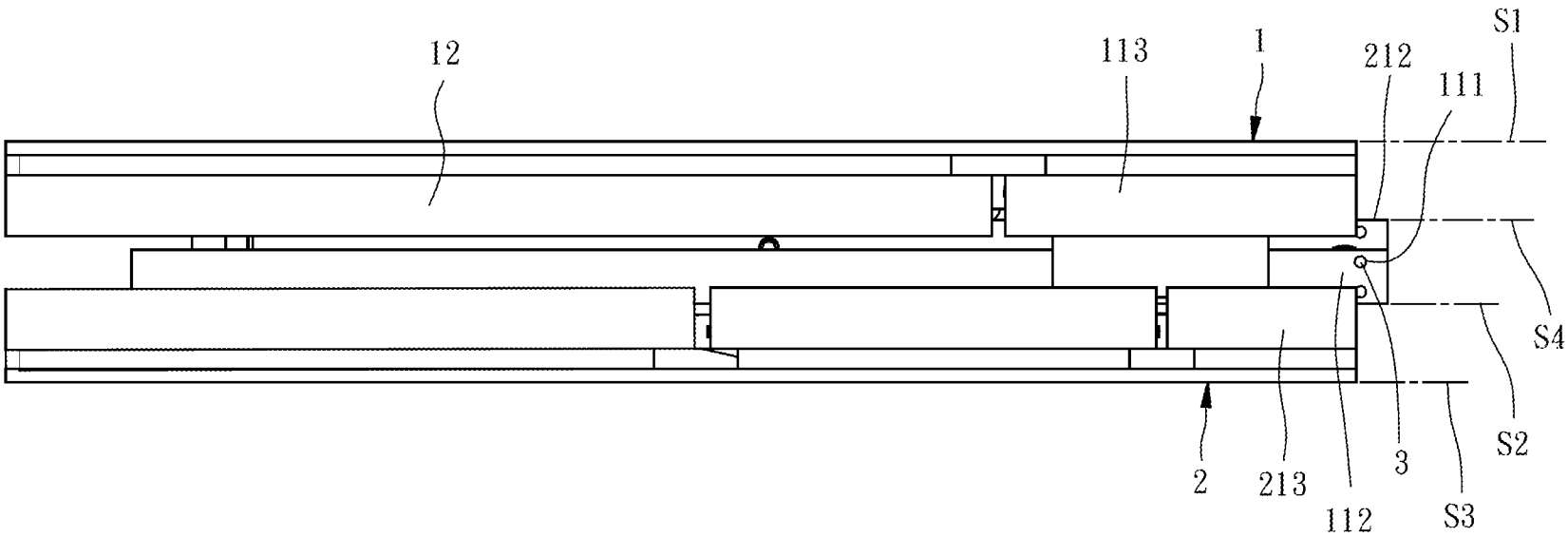
FIG. 7 is a lateral sides view showing the foldable electric bed of the first embodiment of the present invention is folded.

FIGS. 6 and 7 are respectively a perspective view and a lateral side view of the electric bed of the first embodiment, showing that the electric bed 100 is folded. As illustrated above, because the size of the bottom structure of the second fixation frame 21 is smaller than the size of the bottom structure of the first fixation frame 11, the two second longitudinal rods 212 and 212*a* will be located and concealed between the two first longitudinal rods 112 and 112*a*, as shown in FIG. 6, when the first bed frame 1 and the second bed frame 2 are folded with respect to each other. Specifically, in the folded state, at least a part of the outer lateral side of each second longitudinal rod 212 or 212*a* will be overlapped with the inner lateral side of the first longitudinal rod 112 or 112*a* in such a way that the first bottom plane S2 is located between the second top plane S3 and the second bottom plane S4. As a result, an overall height of the folded electric bed 100 will be equal to a distance between the first top plane S1 and the second top plane S2 and will be less than a sum of the first height H1 and the second height H2, thereby achieving the goal of reducing volume and the effect of convenient transportation and storage.

Figure 8:
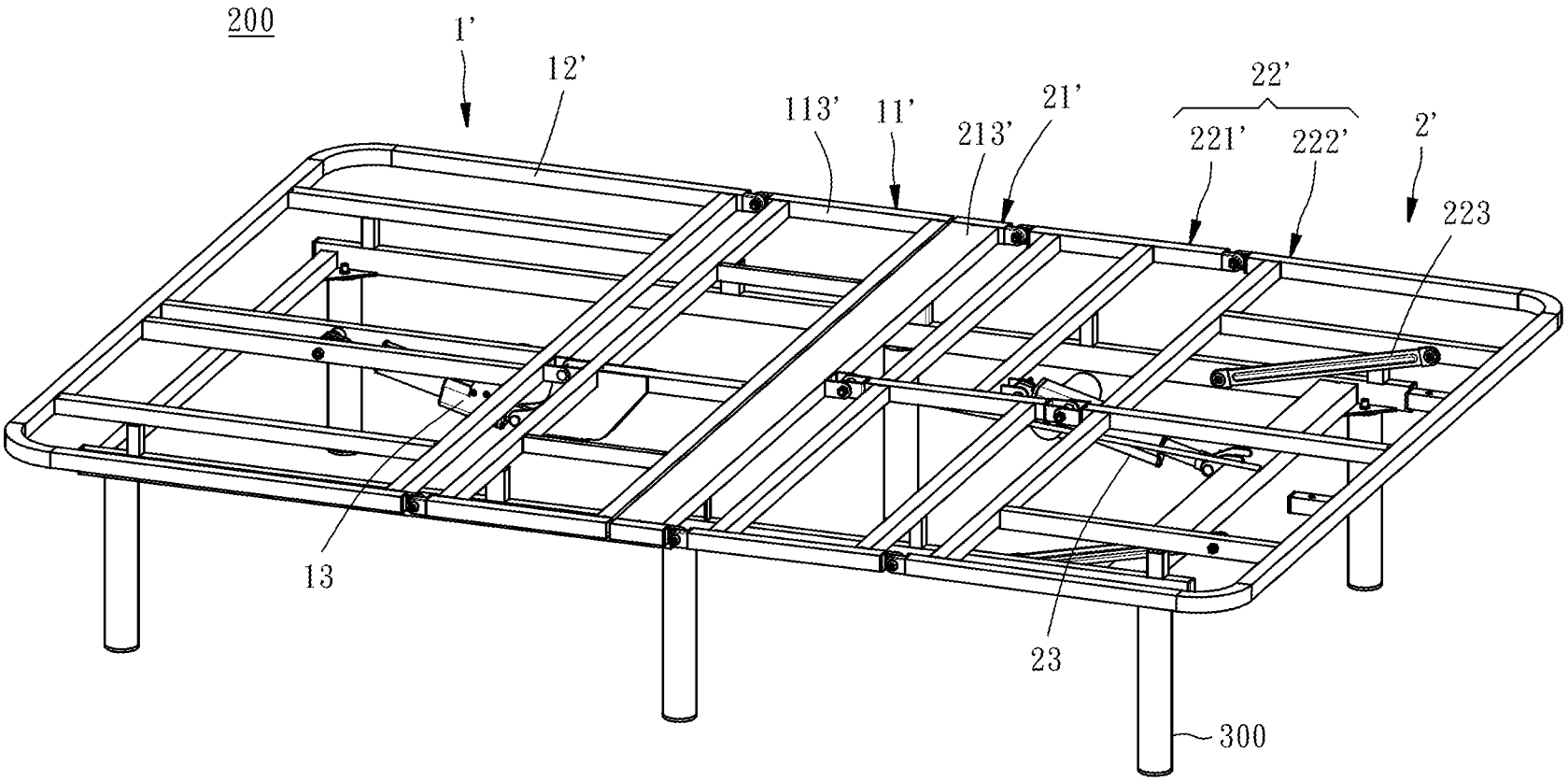
FIGS. 8 and 9 are perspective views of a foldable electric bed according to a second embodiment of the present invention.
Figure 9:
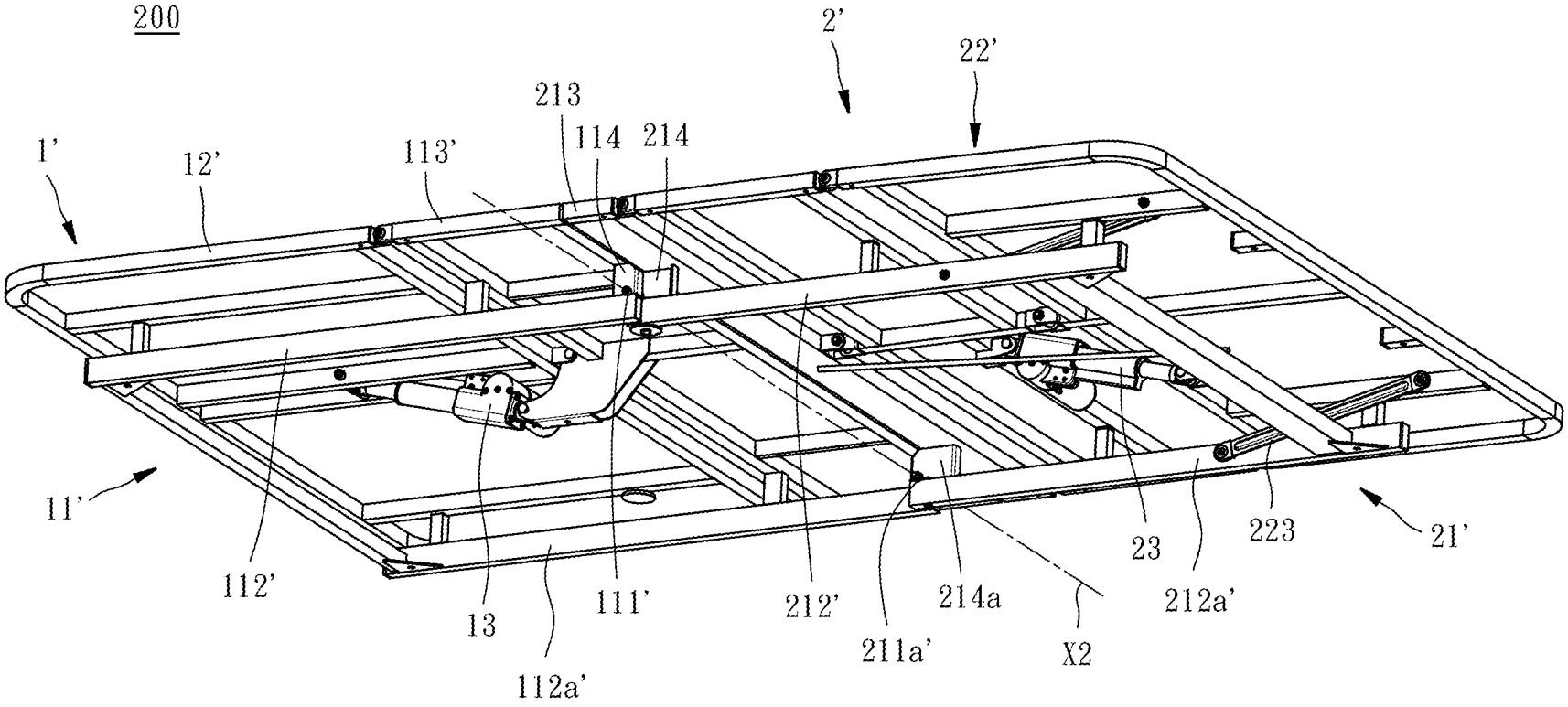
Figure 10:
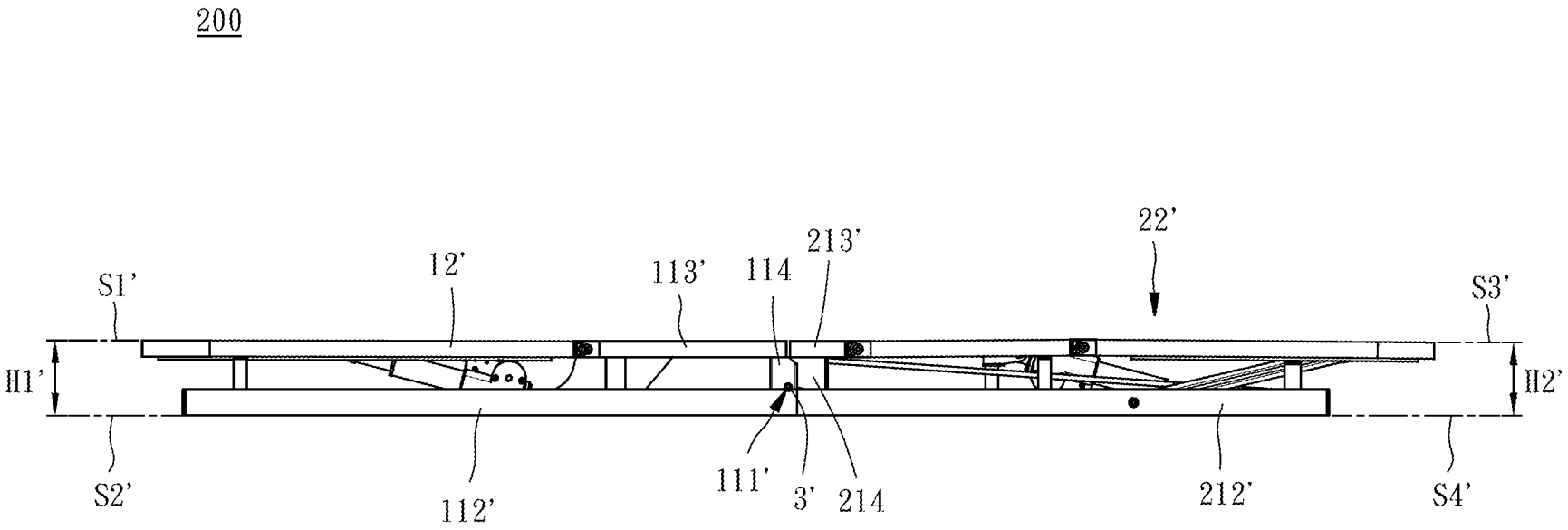
FIG. 10 is a lateral side view of the foldable electric bed of the second embodiment of the present invention.

Based on the technical features of the present invention, various modifications to the structure of the foldable electric bed 100 may be made. For example, FIGS. 8-10 show a foldable electric bed 200 in accordance with a second embodiment of the present invention. The foldable electric bed 200 has a structure basically similar to that of the foldable electric bed 100. The difference between the electric beds 100 and 200 lies in that the pivotally connected mechanism between a first bed frame 1' and a second bed frame 2' are different from that of the first and second bed frames 1 and 2, such that the volume of the electric bed 200 under fold is smaller than the volume of the electric bed 100 under fold.

In the second embodiment of the present invention, the first fixation frame 11' of the first bed frame 1' is provided at a top portion thereof with a first support rack 113' having a front end pivotally connected with a rear end of the first movable frame 12'. The first fixation frame 11' is provided at a bottom portion thereof with two first longitudinal rods 112' and 112*a'*, which are connected with the first support rack 113' via two first connection portions 114 and 114*a*. The two first pivot holes 111' (only one reference number denoting the first pivot hole is depicted in the drawings due to the viewing angle of the drawings) are provided at the two first connection portions 114 and 114*a*, respectively. The second fixation frame 21' of the second bed frame 2' is provided at a top portion thereof with a second support rack 213' having a rear end pivotally connected with a front end of the second movable frame 22'. The second fixation frame 21' is provided at a bottom portion thereof with two second longitudinal rods 212' and 212*a'*, which are connected with the second support rack 213' via two second connection portions 214 and 214*a*. The two second pivot holes 211*a'* (only one reference number denoting the second pivot hole is depicted in the drawings due to the viewing angle of the drawings) are provided at the two second connection portions 214 and 214*a*, respectively.

It is worth mentioning that a distance between each of the two first pivot holes 111' (only one reference number denoting the first pivot hole is depicted in the drawings due to the viewing angle of the drawings) and the first top plane S1' will be greater than a distance between each of the two first pivot hole 111' and the first bottom plane S2'. The electric bed 200 includes two pivot shafts 3' and 3*a'*, which are arranged along a second imaginary axis X2, such that the first fixation frame 11' is pivotally connected with the second fixation frame 21'.

As shown in FIG. 10, the first bed frame 1' has a top edge located at a first top plane S1', a bottom edge located at a first bottom plane S2', and a first height H1' equal to a distance between the first top plane S1' and the first bottom plane S2'. Similarly, the second bed frame 2' has a top edge located at a second top plane S3', a bottom edge located at a second bottom plane S4', and a second height H2' equal to a distance between the second top plane S3' and the second bottom plane S4'.

Figure 11:
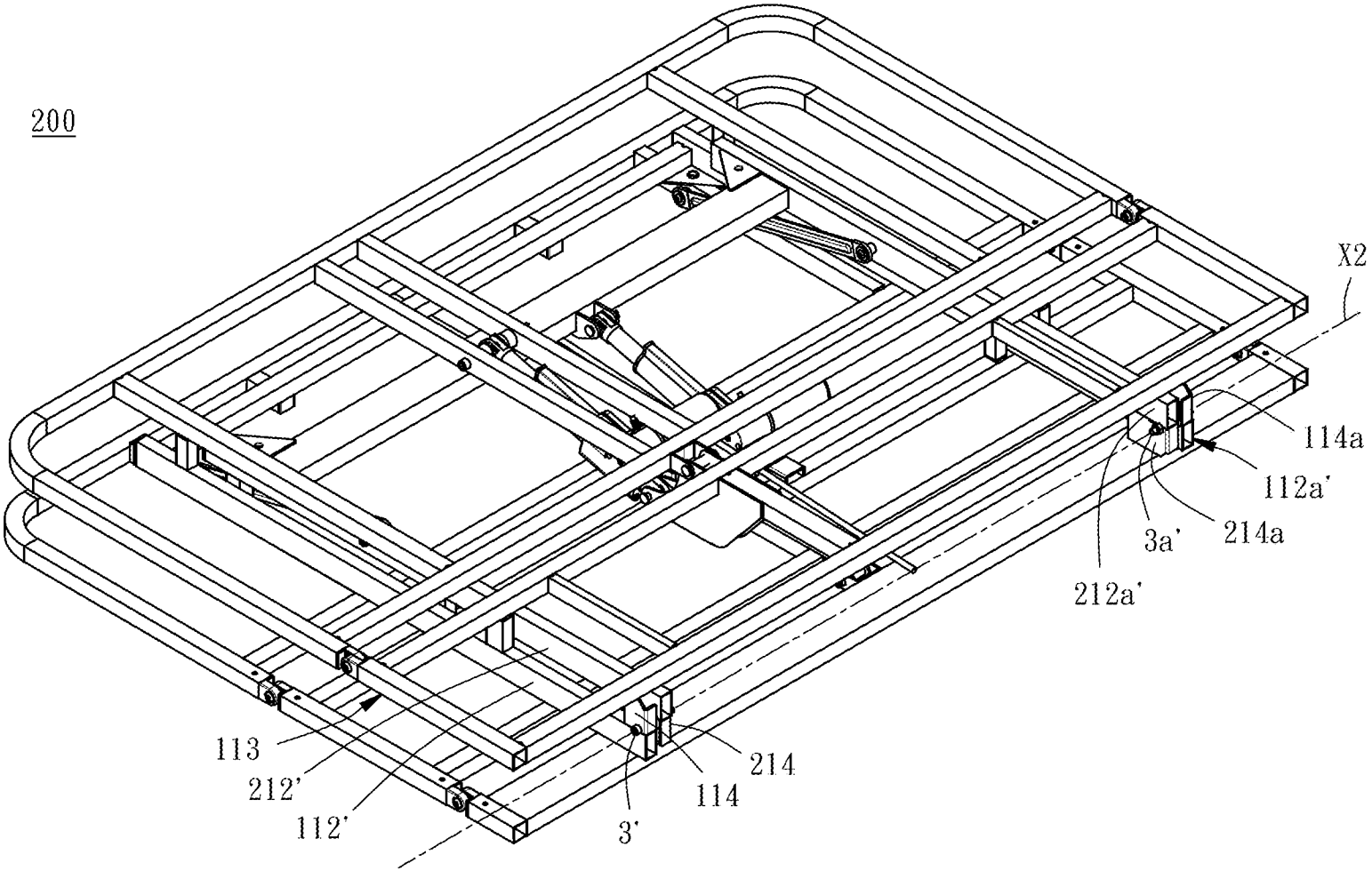
FIG. 11 is a perspective view showing the foldable electric bed of the second embodiment of the present invention is folded.
Figure 12:
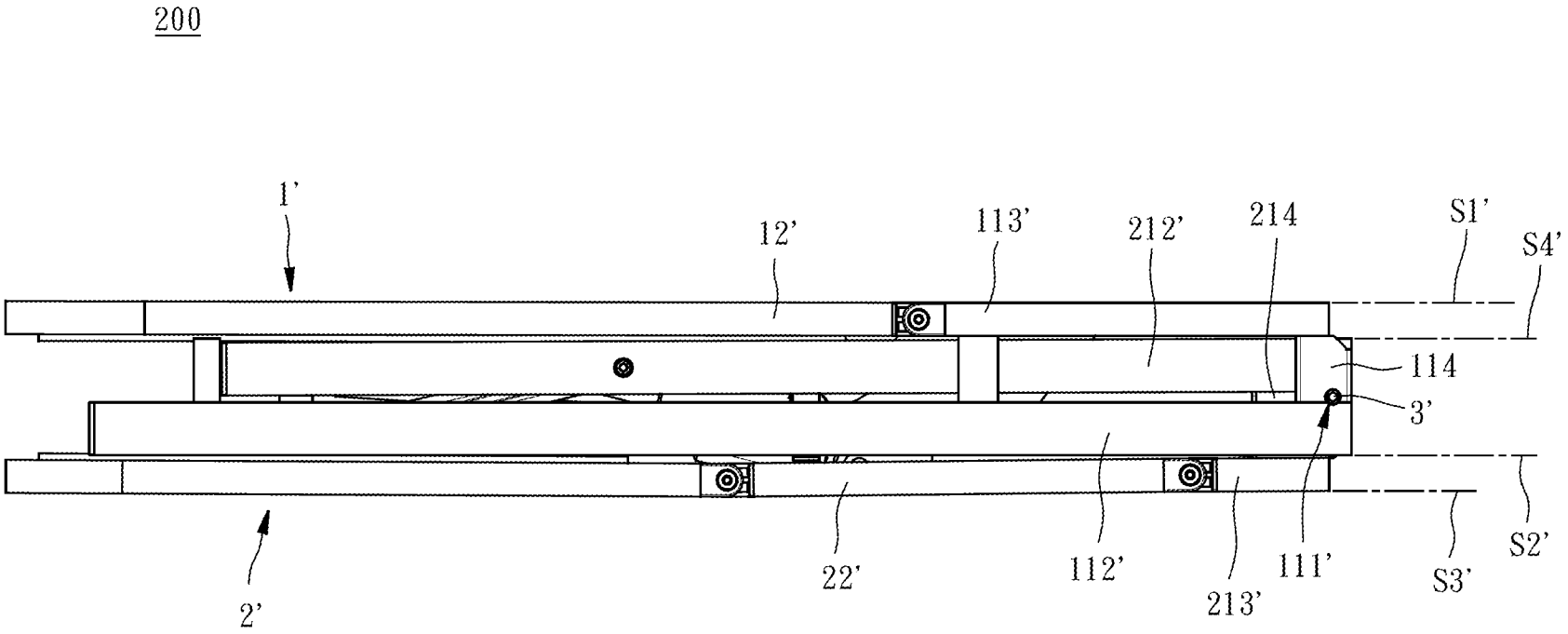
FIG. 12 is a lateral sides view showing the foldable electric bed of the second embodiment of the present invention is folded.

Referring to FIGS. 11 and 12, when the first bed frame 1' and the second bed frame 2' are folded with respect to each other, an overall height of the folded electric bed 200 will be equal to the distance between the first top plane S1' and the second top plane S2' and will be less than a sum of the first height H1' and the second height H2'. Since the elevational position of the two pivot shafts 3' and 3*a'* is higher than that of the two pivot shafts 3 and 3*a* of the first embodiment, the overall height of the folded electric bed 200 will be smaller than that of the folded electric bed 100 of the first embodiment.

In view of the above, compared to conventional foldable electric bed, the foldable electric bed 100 or 200 of the present invention has the effects of reduced volume and convenient transportation and storage.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A foldable electric bed, comprising:

a first bed frame including a first fixation frame, a first moveable frame disposed with the first fixation frame, and a first actuator having two ends disposed with the first fixation and moveable frames, respectively; the first bed frame having a top edge located at a first top plane, a bottom edge located at a first bottom plane, and a first height equal to a distance between the first top plane and the first bottom plane; the first fixation frame having at least one first pivot hole;

a second bed frame including a second fixation frame, a second moveable frame disposed with the second fixation frame, and a second actuator having two ends disposed with the second fixation and moveable frames, respectively; the second bed frame having a top edge located at a second top plane, a bottom edge located at a second bottom plane, and a second height equal to a distance between the second top plane and the second bottom plane and equal to the first height; the second fixation frame having at least one second pivot hole; and at least one pivot shaft inserted through the at least one first pivot hole and the at least one second pivot hole in a way that the first bed frame is rotatable relative to the second bed frame about the at least one pivot shaft, such that the electric bed is foldable;

when the first bed frame and the second bed frame are extended with respect to each other, the first top plane is coplanar with the second top plane, the first bottom plane is coplanar with the second bottom plane, and the electric bed has an overall height equal to the first height;

when the first bed frame and the second bed frame are folded with respect to each other, an overall height of the electric bed under fold is equal to a distance between the first top plane and the second top plane and less than a sum of the first height and the second height.

2. The foldable electric bed as claimed in claim 1, wherein the first fixation frame comprises two said first pivot holes; the at least one second pivot hole is located between the two first pivot holes.

3. The foldable electric bed as claimed in claim 2, wherein the second fixation frame comprises two said second pivot holes, each of which is located between the two first pivot holes.

4. The foldable electric bed as claimed in claim 3, wherein the first fixation frame is provided at a bottom portion thereof with two first longitudinal rods, and each of the two first longitudinal rods has one of the two first pivot holes; the second fixation frame is provided at a bottom portion thereof with two second longitudinal rods, and each of the two second longitudinal rods has one of the two second pivot holes.

5. The foldable electric bed as claimed in claim 4, wherein when the first bed frame and the second bed frame are folded with respect to each other, the two second longitudinal rods are located between the two first longitudinal rods.

6. The foldable electric bed as claimed in claim 3, wherein the first fixation frame is provided at a top portion thereof with a first support rack connected with the two first longitudinal rods via two first connection portions respectively; each of the two first connection portions has one of the two first pivot holes; the second fixation frame is provided at a top portion thereof with a second support rack connected with the two second longitudinal rods via two second connection portions respectively; each of the two second connection portions has one of the two second pivot holes.

7. The foldable electric bed as claimed in claim 1, wherein when the first bed frame and the second bed frame are folded with respect to each other, the first bottom plane is located between the second top plane and the second bottom plane.

8. The foldable electric bed as claimed in claim 1, wherein a distance between the at least one first pivot hole and the first top plane is greater than a distance between the at least one first pivot hole and the first bottom plane.

9. The foldable electric bed as claimed in claim 1, wherein when the first bed frame and the second bed frame are extended with respect to each other, the first top plane is parallel to the first bottom plane, and the second top plane is parallel to the second bottom plane.

* * * * *